US006223753B1

(12) United States Patent
Lo

(10) Patent No.: US 6,223,753 B1
(45) Date of Patent: May 1, 2001

(54) MANUAL HAIRDRESSING AND STYLING DEVICE

(76) Inventor: Zhen-Xing Lo, No. 4, Zhu-Wei Rd., Wei-Nei Village, Kan-Ding Town, Ping-Dong Hsien (TW)

( * ) Notice: Subject to any disclaimer, the term of this patent is extended or adjusted under 35 U.S.C. 154(b) by 0 days.

(21) Appl. No.: 09/411,637

(22) Filed: Oct. 4, 1999

(51) Int. Cl.[7] ..... A45D 1/00
(52) U.S. Cl. ..... 132/224; 132/225
(58) Field of Search ..... 132/223, 224, 132/225, 229, 232, 269; 219/222, 225

(56) References Cited

U.S. PATENT DOCUMENTS 1,762,792 * 6/1930 Ostrowski ..... 132/232
4,242,567 * 12/1980 Carter ..... 132/224
4,739,151 * 4/1988 Smal ..... 219/225
4,870,250 * 9/1989 Rizzuto et al. ..... 132/229
5,779,671 * 9/1998 Takimae ..... 123/225
5,785,064 * 7/1998 Simpson ..... 132/226

FOREIGN PATENT DOCUMENTS

2615267 * 10/1977 (DE) ..... 132/232

* cited by examiner

*Primary Examiner*—Todd E. Manahan
(74) *Attorney, Agent, or Firm*—Dougherty & Troxell

(57) ABSTRACT

A manual hairdressing and styling device includes two clamping members, two heating members, two bases, and two styling members. The two heating members are respectively fixed in an inner side of a front portion of each (an upper and a lower) clamping member, and two bases are respectively fixed on the two heating members for connecting with each (an upper and a lower) styling member made of ceramics. And a plurality of the upper and the lower styling members with different styling surfaces are prepared for changeably connected with the two bases so as to set different hair styles on hairs. And the upper and the lower styling member made of ceramics have an advantage- of protecting hairs from harming.

14 Claims, 6 Drawing Sheets

MANUAL HAIRDRESSING AND STYLING DEVICE

BACKGROUND OF THE INVENTION

This invention relates to a manual hairdressing and styling device, particularly to one provided with a plurality of upper styling members and of lower styling members for selectably used for setting various styles on hairs, having good function for hairdressing and protecting hairs as well.

A known conventional manual hairdressing and styling device shown in FIG. 1 two clamping members 11, and two heating members 12 fixed on the flat surfaces 1110 of the clamping portions 111 located in the front portions of the clamping members 11, a plurality of combing bars 13 spaced apart beside the clamping portions 111. The heating members 12 alters electricity into heat for warming hairs. Then a hair dresser holds grips of the clamping members 11 for clamping hairs for warming and then gradually move the clamping members 11 rearward. Then hairs are combed first by the combing bars 13, and set into a straight condition by the flat surfaces 1110.

However, the conventional manual hairdressing and styling device has only a function for straighten hairs, not a good hair dressing function because of aluminum heaters, and there is potent danger of harming quality of hairs.

SUMMARY OF THE INVENTION

This invention has been devised to offer a kind of manual hairdressing and styling device provided with a plurality of upper styling members and of lower styling members for selectably and changeably used for setting different styles on hairs, having good heating function and protecting hairs from harming as well.

The feature of the invention is two heating members provided in flat surfaces of a clamping mouth in the front portions of two clamping members and flush with the flat surfaces, two bases fixed on the two heating members, and two—an upper and a lower—styling members made of ceramics. The upper and the lower styling members are changeable to be connected with the two bases, and a plurality of them are provided to have different styling surfaces for selecting and changeably used by connected to the two bases by means of dove-tail shaped grooves and projections so that changing the upper and lower styling member can be performed quickly. and easily.

BRIEF DESCRIPTION OF DRAWINGS

This invention will be better understood by referring to the accompanying drawings, wherein.

DETAILED DESCRIPTION OF THE PREFERRED EMBODIMENTS

Figure 1:
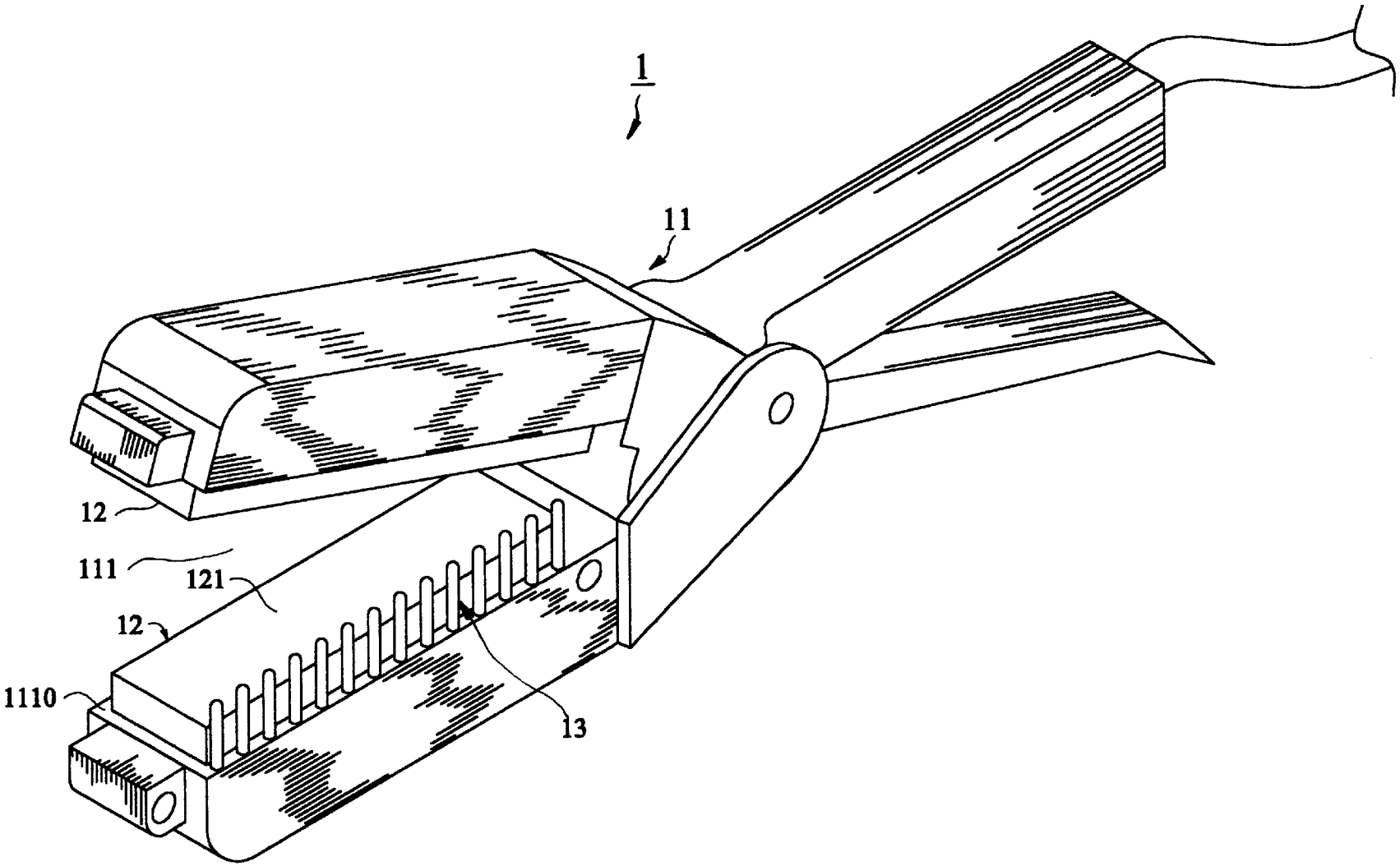
FIG.1 PRIOR ART
FIG. 1 is a perspective view of a known conventional manual hairdressing and styling device.
Figure 2:
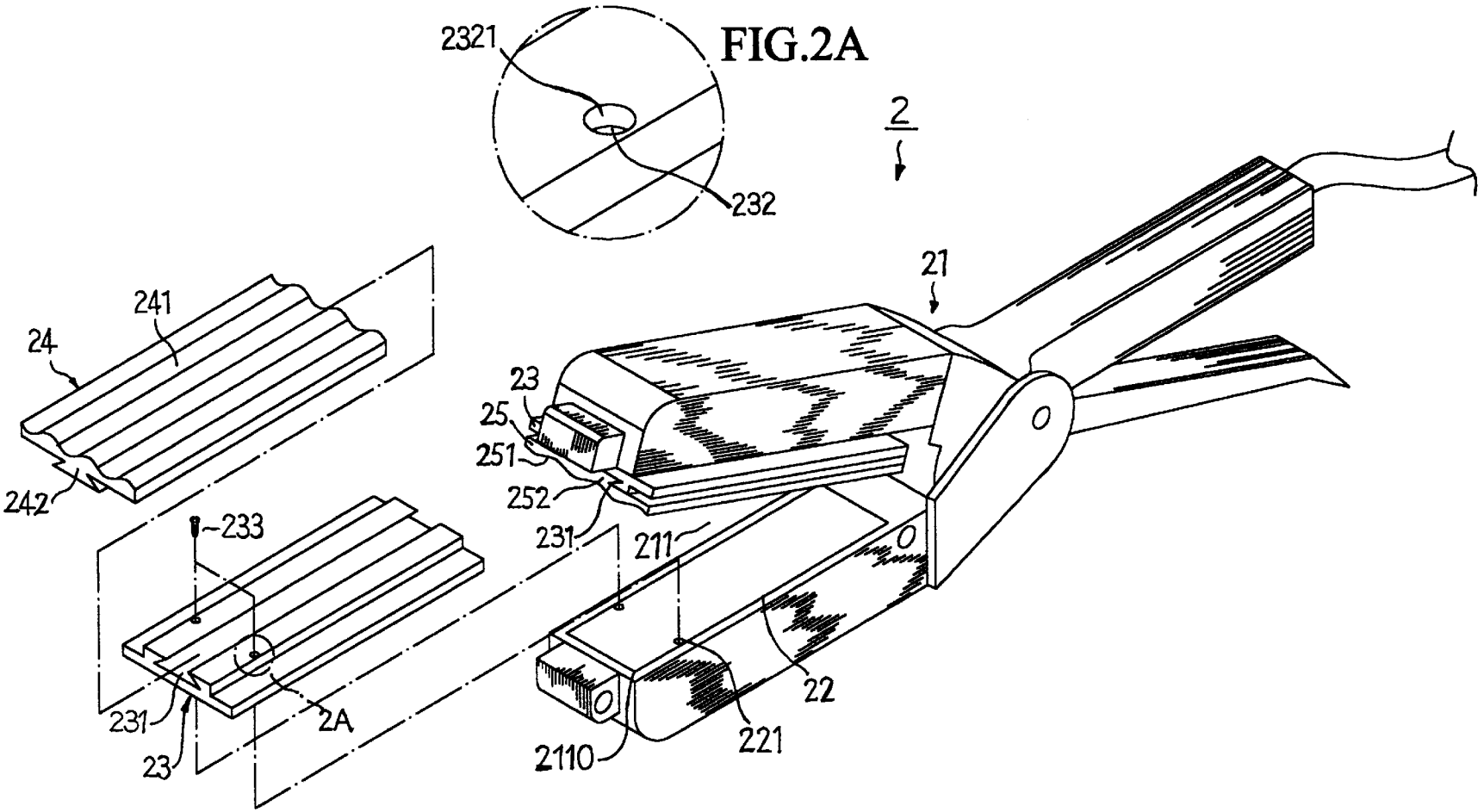
FIG. 2 is an exploded perspective view of a manual hairdressing and styling device in the present invention.
Figure 3:
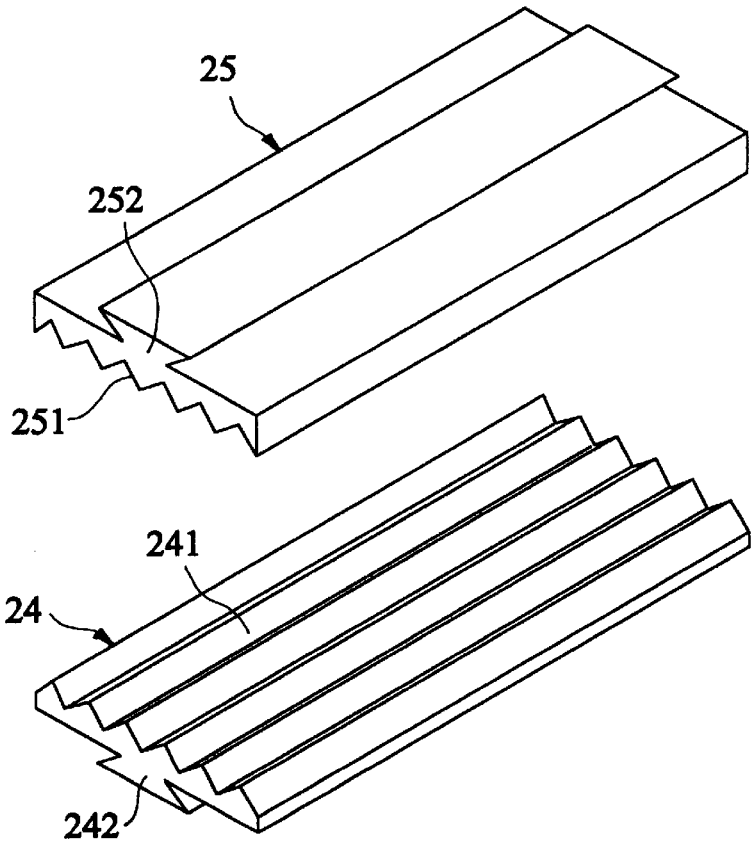
FIG. 3 is another embodiment of an upper styling member and a lower styling member in the present invention.
Figure 4:
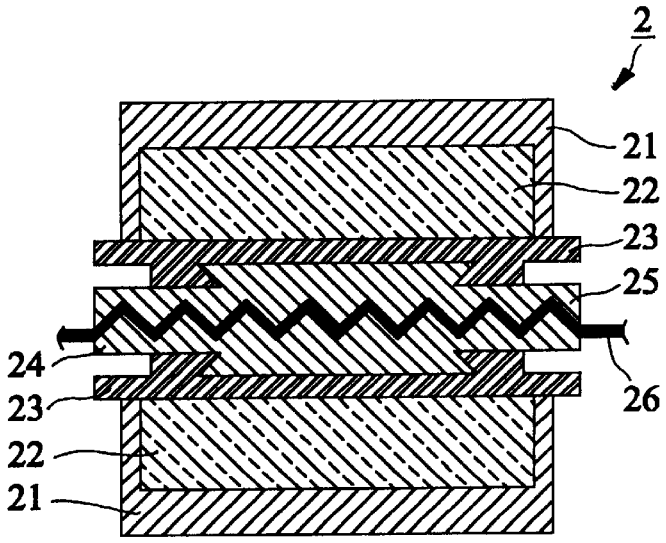
FIG. 4 is a cross-sectional view of the manual hairdressing and styling device in the present invention.

A first embodiment of a manual hairdressing and styling device in the present invention, as shown in FIGS. 2 and 3, includes at least two clamping members 21 and two heating members 22 fixed on two flat surfaces of a clamping mouth 211 of the clamping members 21 and having a heater for altering electricity into heat for heating the heating members 22.

The two heating members 22 are respectively fixed in an inner flat surfaces 2110 of the clamping mouth 211 and located flush with or only a little higher than the inner flat surfaces 2110, and having more than two threaded holes 221 in an outer surface to fix an upper and a lower styling member 24 and 25 respectively on the two heating members 22 closely.

Two bases 23 are provided respectively with a engage groove 231 in the intermediate portion of an outer surface, more than two through holes aligned to the threaded holes 221 of the two heating members 22 for bolts 233 to fix the base 23 closely on the heating member 22. The engage groove 231 is shaped as a dove-tail to easily connect with the upper and the lower styling member 25 and 24. The through holes 232 respectively have a large diameter section for the head of the bolt 233 to fit in so as not to protrude out of the outer surface of the base 23 to hamper connecting with the upper and the lower styling member 25 and 24.

The lower styling member 24 is made of ceramics, having a regular curve surface 241 formed in an outer surface for styling hairs, and a projection 242 formed in an intermediate lengthwise portion to engage with the engage groove 231 of the base 23. The projection 242 may be shaped as a dove-tail so as to easily connect with or disconnect from the engage groove 231, then different lower styling members 24 may be prepared, having different styling surfaces 241 such as flat, triangular, curved or wave surface for styling hairs of various shapes.

The upper styling member 25 is also made of ceramics, having a curved surface 251 as the same as the regular curve surface 241 of the lower styling member 24, and an engage projection 252 in an intermediate lengthwise portion of an upper surface to engage with the engage groove 231 of the base 23. The engage projection 251 may be shaped as a dove-tail so as to easily connect or disconnect the upper styling member 25 with the base 23. Then a plurality of the upper styling members 25 with different styling surfaces 251 may be prepared for styling hairs of various shapes in the same way of the lower styling member 24.

In using the manual hairdressing and styling device, firstly, choose a lower styling member 24 and an upper styling member 25 having the hair style needed, then connect them with the bases 23. Then turn on the heating members 22. After the heat of the heating members 22 is transmitted to the bases 23 and then to the upper and the lower styling members 25, the upper and and the lower styling members 25 and 24 may produce far infrared light of 6000 nm–40,000 nm. In hairdressing process, the clamping members 21 continue to clamp hairs for a proper time to let the hairs get warmed up and set into the style of the styling surfaces 251, 241 of the upper and the lower styling member 25 and 24, and then is moved slowly and gradually rearward. And it is worth to mention that far infrared light produced by the the upper and the lower styling member 25 and 24 has protective function during hairdressing, never harming hairs but letting the inner organization of hairs get more nourished. In addition, hairs can keep curling for a comparative long time after treated by the upper and the lower styling member 25 and 24 made of ceramics.

Figure 5:
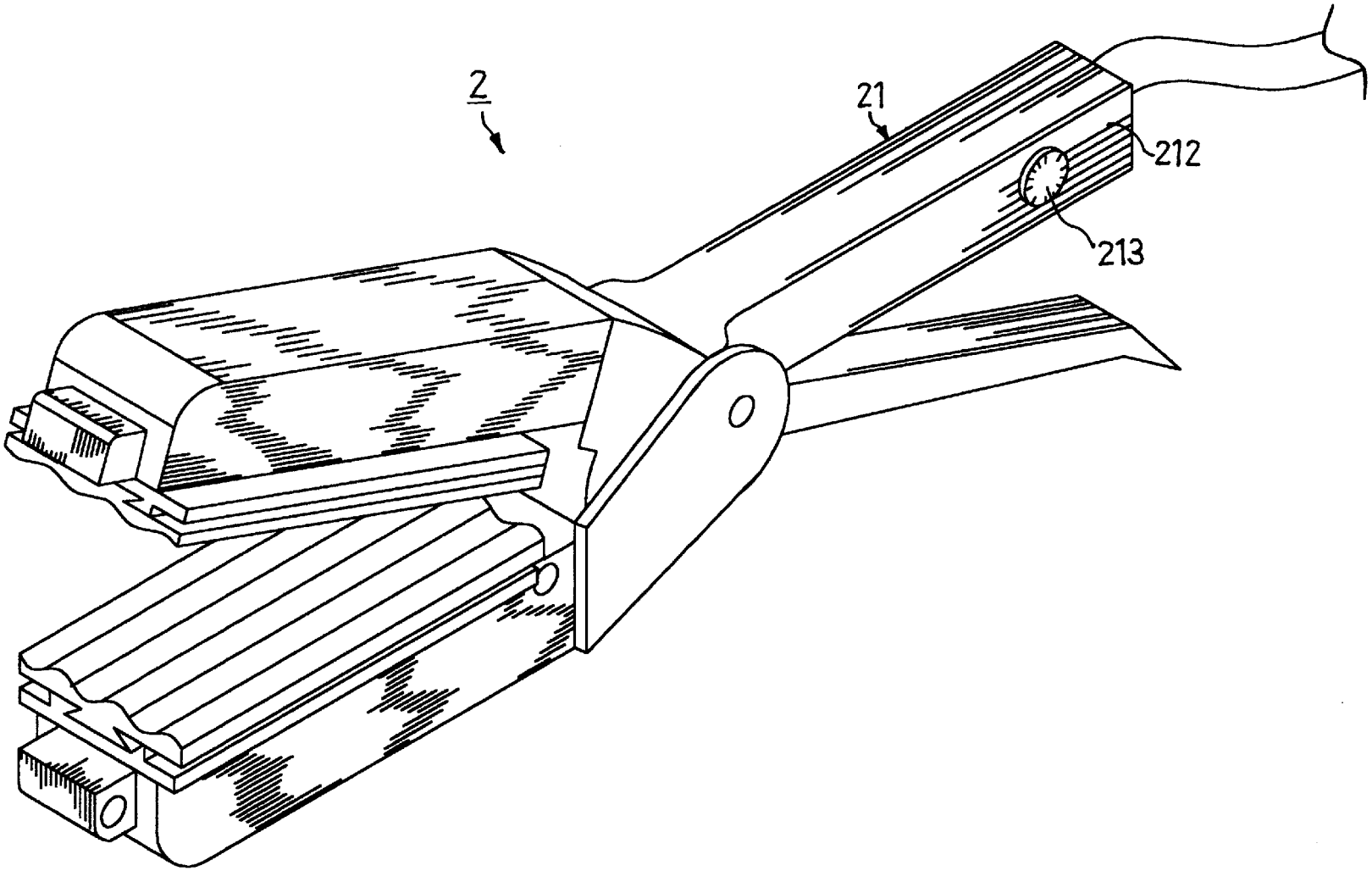
FIG. 5 is a perspective view of the manual hairdressing and styling device additionally provided with a temperature adjuster in the present invention.

Next, FIG. 5 shows the manual hairdressing and styling device additionally provided with a temperature adjuster 213 fixed in an outer surface of one grip 212 formed in the rear portion of the clamping members 21, for controlling the heating members 22 so that a person receiving hairdressing may feel comfortable during hairdressing process by means of proper temperature.

Figure 6:
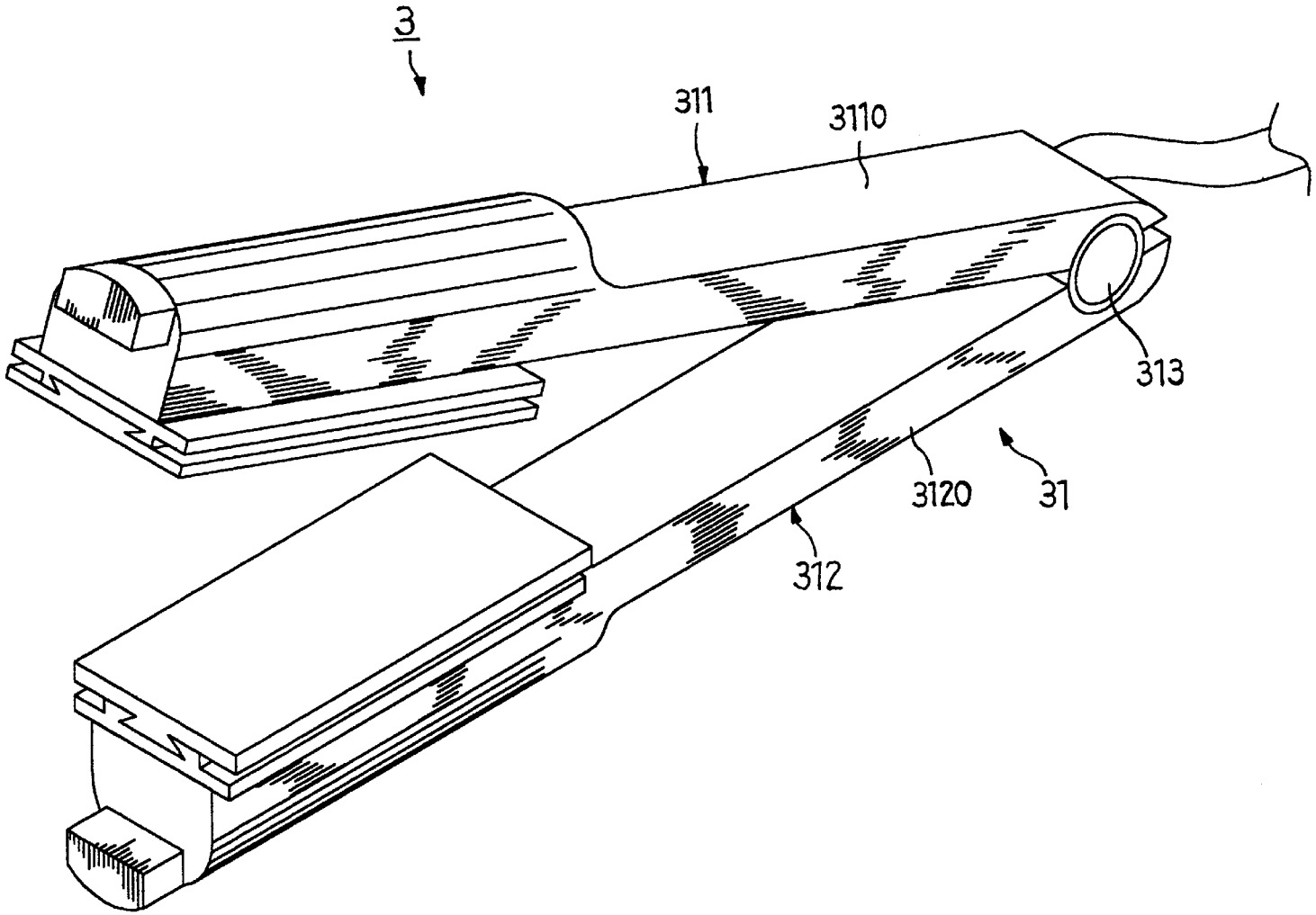
FIG. 6 is a perspective view of a second embodiment of a manual hairdressing and styling device in the present invention; and, FIG. 7 is a perspective view of a trapezoidal upper and a trapezoidal lower styling member in the present invention.

FIG. 6 shows a second embodiment of a manual hairdressing and styling device in the invention, including two clamping members 31, two heating members, two bases, and an upper and a lower styling members 32 and 33 as the first embodiment has. But the upper and the lower clamping member 311, 312 are pivotally connected with each other at their rear end with a pivot 313 so as to swing up and down for clamping hairs. Two grip portions 3110, 3120 are formed between the pivot 313 and the upper and the lower styling members 32 and 33 for a hand of a user to clamp the clamping portions 311, 312. Then the space between the upper and the lower styling member 32 and 33 can be comparative wide by provision of the grip portions 3110, 3120 so that changing the upper and the lower styling member 32 and 33 and hair dressing work can be very convenient. In addition, a temperature adjuster may be provided in the outer surface of the grip 3110 or 3120 for controlling the temperature of the heating members. The upper and the lower styling members 32 and 33 of the second embodiment are especially suitable for straightening hairs, having regular flat surfaces.

Figure 7:
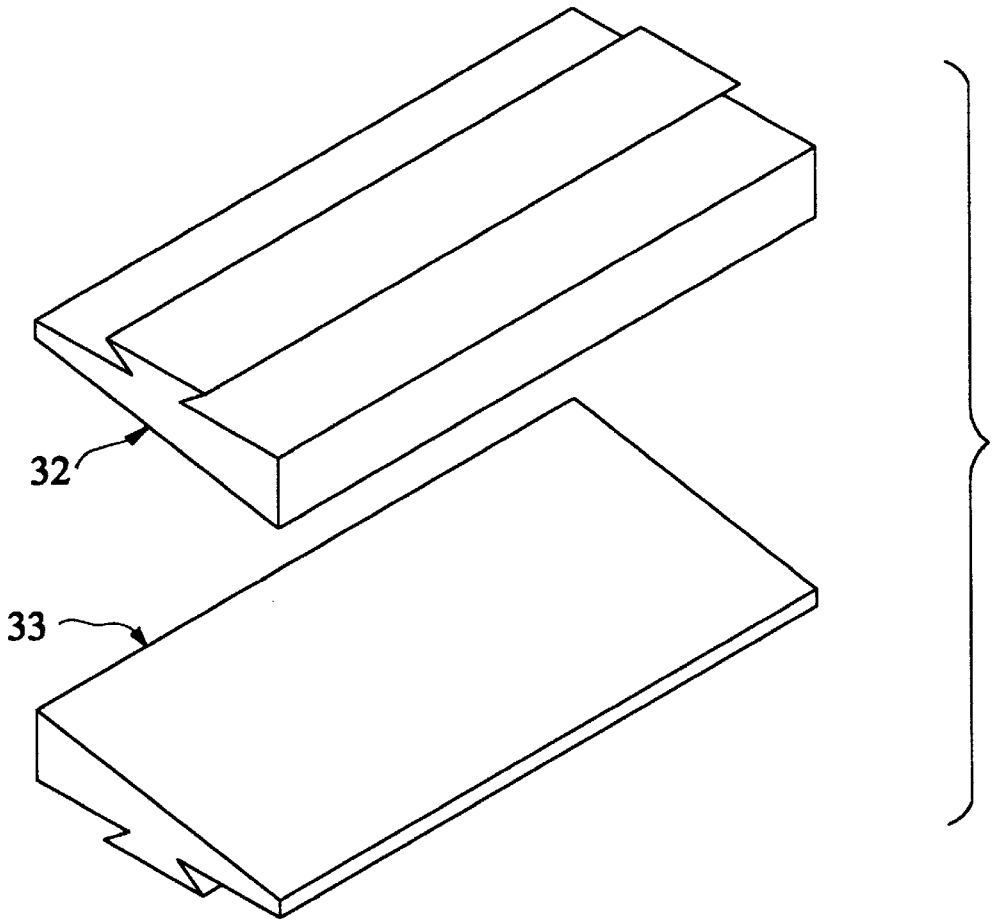

Besides, FIG. 7 shows an upper and an lower styling member 32 and 33 having a trapezoidal shape, forming hairs naturally curling a little to make a new style for users'pleasure.

While the preferred embodiments of the invention have been described above, it will be recognized and understood that various modifications may be made therein and the appended claims are intended to cover all such modifications which may fall within the spirit and scope of the invention.

What is claimed is:

1. A manual hairdressing and styling device comprising at least two clamping members, two heating members fixed on two sides of a clamping mouth formed in a front portion of said two clamping members, said two heating members respectively having a heater for changing electricity into heat to heat up said heating members; and characterized by, said two heating members fixed flush with flat surfaces of said clamping mouth of said clamping members;

two bases respectively fixed closely on each said heating member, having a lengthwise engage groove formed in an intermediate portion of an outer surface;

a lower styling member having a styling surface formed on an outer surface, and an engage projection formed on a lower surface to engage said engage groove of a lower one of said two bases;

an upper styling member having a styling surface formed on an outer surface, and an engage projection formed on an inner surface to engage said engage groove of an upper one of said two bases.

2. The manual hairdressing and styling device as claimed in claim 1, wherein said two heating members have respectively more than two threaded holes, and said two bases respectively have more than two through holes aligned to said threaded holes of said heating members for bolts to pass through and screwed with for fixing one end of said bases closely with said heating members.

3. The manual hairdressing and styling device as claimed in claim 1, wherein said engage grooves of said two bases and said engage projections of said upper and said lower styling member are all shaped as a dove-tail.

4. The manual hairdressing and styling devices as claimed in claim 1, wherein a temperature adjuster is additionally fixed in an outer surface of any of said grips of said clamping members, for controlling the temperature of said two heating members so as to get proper temperature for a person receiving hairdressing and styling to feel comfortable during the process.

5. The manual hairdressing and styling device as claimed in claim 1, wherein said styling surface of said upper and lower styling member is a regular curve one.

6. The manual hairdressing and styling device as claimed in claim 1, wherein said styling surface of said upper and said lower styling member is a regular triangular one.

7. The manual hairdressing and styling device as claimed in claim 1, wherein said upper and said lower styling member are shaped trapizoidal.

8. The manual hairdressing and styling device as claimed in claim 1, wherein said styling surface of said upper and said lower styling member is a regular flat surface for straightening hairs.

9. The manual hairdressing and styling device as claimed in claim 1, wherein said upper and said lower clamping member are pivotally connected with each other at their rear ends with a pivot for said upper and said lower clamping member to swing open or closed to clamp hairs between them, two grips formed between said pivot and said upper and said lower styling member for swinging open or closed said two clamping members so that changing said upper and said lower styling member and hairdressing work may be performed easily and conveniently.

10. The manual hairdressing and styling devices as claimed in claim 9, wherein a temperature adjuster is additionally fixed in an outer surface of any of said grips of said clamping members, for controlling the temperature of said two heating members so as to get proper temperature for a person receiving hairdressing and styling to feel comfortable during the process.

11. The manual hairdressing and styling device as claimed in claim 9, wherein said styling surface of said upper and lower styling member is a regular curve one.

12. The manual hairdressing and styling device as claimed in claim 9, wherein said styling surface of said upper and said lower styling member is a regular triangular one.

13. The manual hairdressing and styling device as claimed in claim 9, wherein said upper and said lower styling member are shaped trapizoidal.

14. The manual hairdressing and styling device as claimed in claim 9, wherein said styling surface of said upper and said lower styling member is a regular flat surface for straightening hairs.

* * * * *